US008967891B2

(12) United States Patent
Igarashi

(10) Patent No.: US 8,967,891 B2
(45) Date of Patent: Mar. 3, 2015

(54) METHODS AND DEVICES FOR TRANSPORTING A MEDIUM IN A PRINTING APPARATUS

(75) Inventor: Hitoshi Igarashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 366 days.

(21) Appl. No.: 12/898,812

(22) Filed: Oct. 6, 2010

(65) Prior Publication Data

US 2011/0085842 A1 Apr. 14, 2011

(30) Foreign Application Priority Data

Oct. 14, 2009 (JP) ..... 2009-237533

(51) Int. Cl.
*B65H 16/10* (2006.01)
*B41J 11/42* (2006.01)

(52) U.S. Cl.
CPC ..... *B65H 16/10* (2013.01); *B65H 2403/942* (2013.01); *B65H 2511/142* (2013.01); *B65H 2515/32* (2013.01); *B65H 2515/704* (2013.01); *B65H 2801/12* (2013.01)
USPC ..... 400/611; 400/583; 400/617; 400/618; 242/418; 242/420; 242/420.5; 226/43

(58) Field of Classification Search
CPC .... B65H 16/10; B65H 16/103; B65H 16/106; B65H 2511/142; B65H 23/185
USPC ..... 400/583, 611, 617, 618; 101/121; 271/9.1; 399/388; 347/5; 242/410, 416, 242/418, 419.2, 420, 420.5; 226/24, 26, 43
See application file for complete search history.

(56) References Cited

U.S. PATENT DOCUMENTS

| | | | | |
|---|---|---|---|---|
| 5,216,444 | A * | 6/1993 | Noguchi et al. | 346/136 |
| 6,619,778 | B2 | 9/2003 | Igarashi | |
| 2008/0011805 | A1 | 1/2008 | Genta et al. | |
| 2009/0213180 | A1 * | 8/2009 | Silverbrook | 347/42 |
| 2009/0226235 | A1 * | 9/2009 | Kobayashi et al. | 400/614 |
| 2009/0245912 | A1 * | 10/2009 | Igarashi et al. | 400/618 |

FOREIGN PATENT DOCUMENTS

| | | | | |
|---|---|---|---|---|
| JP | 63-154593 A | | 6/1988 | |
| JP | 63225037 | * | 9/1988 | B65H 3/06 |
| JP | 05162909 | * | 6/1993 | B65H 23/185 |
| JP | 07-237796 A | | 9/1995 | |
| JP | 2000-143051 A | | 5/2000 | |

(Continued)

OTHER PUBLICATIONS

Machine Translation of JP Publ. No. 2000-143051 to Sakai et al. published on May 23, 2000.*

*Primary Examiner* — Blake A Tankersley
(74) *Attorney, Agent, or Firm* — Nutter McClennen & Fish LLP

(57) ABSTRACT

A printing apparatus includes: a motor which drives a shaft of a roll body around which a medium is wound, in the feeding direction of the medium; a transport roller which transports the medium fed from the roll body; and a control section which supplies electric power for rotating the roll body to the motor, wherein the electric power that the control section supplies to the motor at the time of the start of the feeding of the medium is larger when the diameter of the medium that is wound around the roll body is R2 (<R1) than when the diameter of the medium that is wound around the roll body is R1.

9 Claims, 17 Drawing Sheets

(56) References Cited

FOREIGN PATENT DOCUMENTS

| | | | |
|---|---|---|---|
| JP | 2003-048351 | A | 2/2003 |
| JP | 2003-079177 | A | 3/2003 |
| JP | 2006-008322 | A | 1/2006 |
| JP | 2006-240212 | A | 9/2006 |
| JP | 2007-290866 | A | 11/2007 |

* cited by examiner

METHODS AND DEVICES FOR TRANSPORTING A MEDIUM IN A PRINTING APPARATUS

BACKGROUND

1. Technical Field

The present invention relates to a printing apparatus.

2. Related Art

For example, among ink jet type printers, there is a printer of a type which uses large-sized paper having a paper size of A2 or more. In the ink jet printer for such a large-sized-paper, besides single sheets of paper, so-called roll paper is often used. In addition, in the following, the so-called roll paper which is wound around a roll body, and a portion which is drawn from the roll body is referred to as paper.

At present, the drawing of the paper from the roll body is performed by rotationally driving a transport roller by a paper feed motor (hereinafter also referred to as a PF motor). In addition, the PF motor is controlled and driven by PID control.

As a printer which uses such a roll body, there is a printer which is disclosed in JP-A-2007-290866. Also, as printers which perform the PID control, there are printers which are disclosed in JP-A-2006-240212, JP-A-2003-79177, and JP-A-2003-48351.

Usually, the transport roller is provided spaced a certain distance in a direction in which the paper is supplied from the roll body mounted on a printer main body. Therefore, there is also a case where it is difficult to transport the paper only by the transport roller. Therefore, there is also proposed a printing apparatus in which a roll motor (hereinafter also referred to as an RR motor) which rotationally drives the roll body is provided and rotates the roll body, thereby transporting the paper.

However, in the printing apparatus as described above, in the case of using slippery paper (medium), there is a problem that if the diameter of the medium that is wound around the roll body is reduced, transport precision falls at the time of the start of the feeding of the paper, so that image quality may deteriorate.

SUMMARY

An advantage of some aspects of the invention is that it prevents deterioration of image quality.

According to an aspect of the invention, there is provided a printing apparatus including: a motor which drives a shaft of a roll body around which a medium is wound, in the feeding direction of the medium; a transport roller which transports the medium fed from the roll body; and a control section which supplies electric power for rotating the roll body to the motor, wherein the electric power that the control section supplies to the motor at the time of the start of the feeding of the medium is larger when the diameter of the medium that is wound around the roll body is R2 (<R1) than when the diameter of the medium that is wound around the roll body is R1.

Other aspects of the invention will become apparent from the description of this specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

At least the following matters will become apparent from the description of this specification and the accompanying drawings.

A printing apparatus will become apparent which includes: a motor which drives a shaft of a roll body around which a medium is wound, in the feeding direction of the medium; a transport roller which transports the medium fed from the roll body; and a control section which supplies electric power for rotating the roll body to the motor, wherein the electric power that the control section supplies to the motor at the time of the start of the feeding of the medium is larger when the diameter of the medium that is wound around the roll body is R2 (<R1) than when the diameter of the medium that is wound around the roll body is R1.

According to such a printing apparatus, it is possible to transport the medium with high precision regardless of the diameter of the medium that is wound around the roll body. Accordingly, it is possible to prevent deterioration of image quality.

In such a printing apparatus, it is preferable that the electric power that the control section supplies to the motor at the time of the start of the feeding of the medium include first assistance power which assists the driving of the motor without depending on the diameter of the medium that is wound around the roll body and second assistance power which assists the driving of the motor in accordance with the diameter of the medium that is wound around the roll body.

According to such a printing apparatus, it is possible to make the motor be easily driven at the time of the start of the feeding of the medium.

In such a printing apparatus, it is preferable that the second assistance power be in inverse proportion to the diameter of the medium that is wound around the roll body.

According to such a printing apparatus, it is possible to reduce a slippage amount regardless of the diameter of the medium that is wound around the roll body.

In such a printing apparatus, it is preferable that the control section adjust the electric power which is supplied to the motor, by changing a duty value in PWM control.

According to such a printing apparatus, it is possible to accurately and easily control the electric power which is supplied to the motor.

In such a printing apparatus, it is preferable that the medium be a medium more slippery than plain paper upon transportation by the transport roller.

In this case, the effect of further prevention in deterioration of image quality can be obtained.

In the following embodiment, as one example of a printing apparatus, the case of a printer will be explained.

Concerning the Configuration of the Printer

Figure 1:
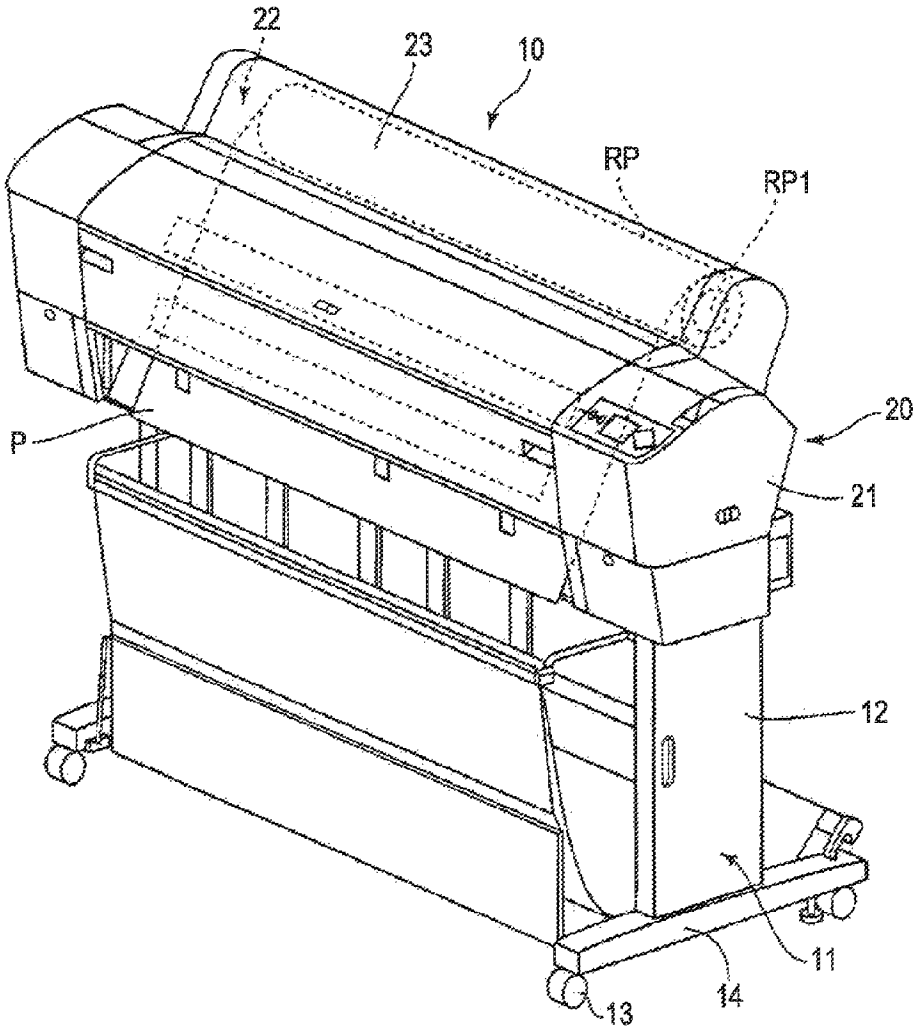
FIG. 1 is a diagram showing a configuration example of the appearance of a printer.
Figure 3:
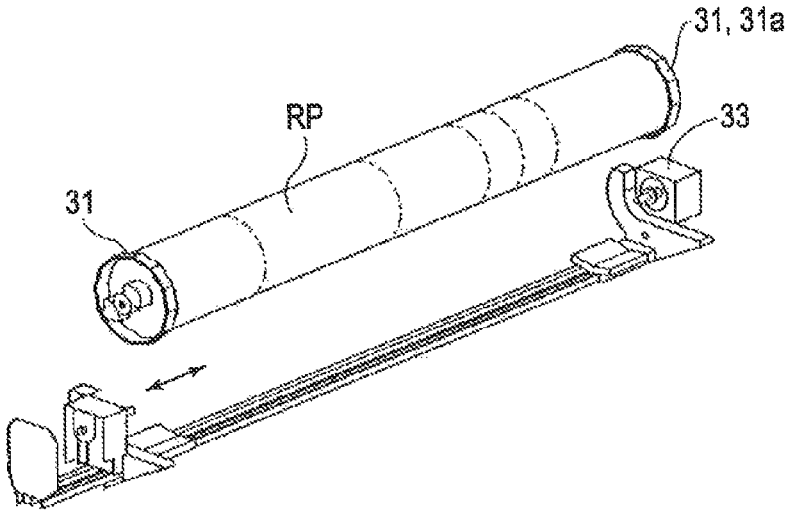
FIG. 3 is a diagram showing a configuration example of the appearance of a rotating holder and an RR motor.
Figure 2:
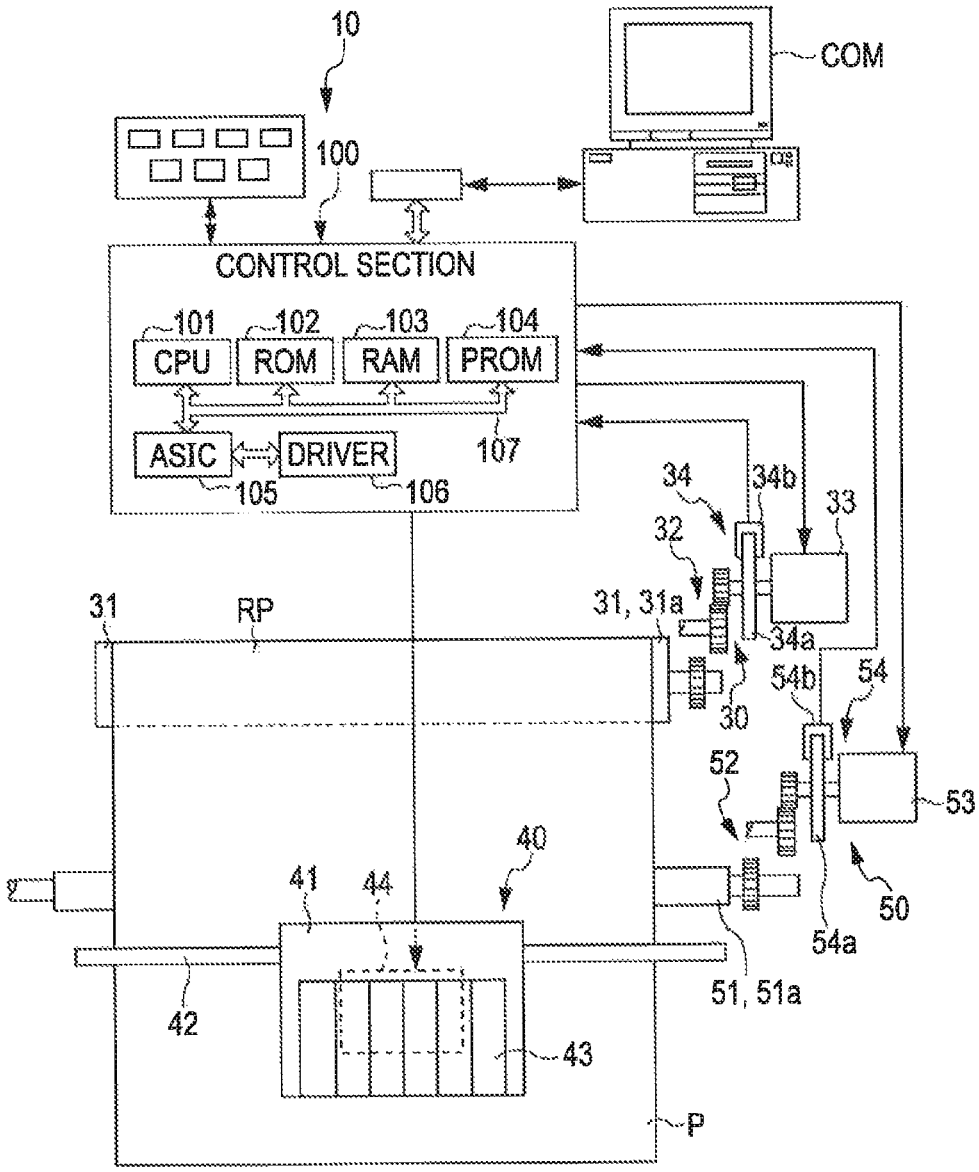
FIG. 2 is a diagram showing the relationship between a drive system which uses a DC motor and a control system in the printer.

FIG. 1 is a diagram showing a configuration example of the appearance of a printer 10 related to this embodiment. FIG. 2 is a diagram showing the relationship between a drive system which uses a DC motor and a control system in the printer 10 of FIG. 1. FIG. 3 is a diagram showing a configuration example of the appearance of a rotating holder 31 and an RR motor (roll motor) 33.

In the case of this example, the printer 10 has a pair of leg portions 11 and a main body portion 20 which is supported by the leg portions 11. A support post 12 is provided at the leg portion 11, and rotatable casters 13 are mounted on a caster support portion 14.

A variety of internal devices are mounted on the main body portion 20 in a state where they are supported by a chassis (not shown), and are covered by an outer case 21. Also, as shown in FIG. 2, as a drive system which uses a DC motor, a roll driving mechanism 30, a carriage driving mechanism 40, and a paper transport mechanism 50 are mounted in the main body portion 20.

The roll driving mechanism 30 is provided at a roll mounting portion 22 which exists on the main body portion 20. The roll mounting portion 22 is provided on the upper side of the rear face side of the main body portion 20, as shown in FIG. 1, so that a roll body RP is mounted in the inside of the roll mounting portion by opening an opening and closing lid 23 which is one element that constitutes the above-mentioned outer case 21, and the roll body RP can be rotationally driven by the roll driving mechanism 30.

Also, the roll driving mechanism 30 for rotating the roll body RP has the rotating holders 31, a gear wheel train 32, the RR motor 33, and a rotation detection section 34, as shown in FIGS. 2 and 3.

The rotating holders 31 are inserted at both end sides of a hollow hole RP1 which is provided at the roll body RP, and a pair of rotating holders is provided in order to support the roll body RP from both end sides.

The RR motor 33 provides a driving force (a turning force) to a rotating holder 31*a* which is located on one end side, among a pair of rotating holders 31, through the gear wheel train 32.

In this embodiment, the rotation detection section 34 uses a rotary encoder. Therefore, the rotation detection section 34 is provided with a disc-shaped scale 34*a* and a rotary sensor 34*b*. The disc-shaped scale 34*a* has light transmitting portions which allow light penetration and light shielding portions which block the penetration of light, at constant intervals along the circumferential direction thereof. Also, the rotary sensor 34*b* has a light emitting element (not shown), a light receiving element (not shown), and a signal processing circuit (not shown), as main components.

Figure 4A:
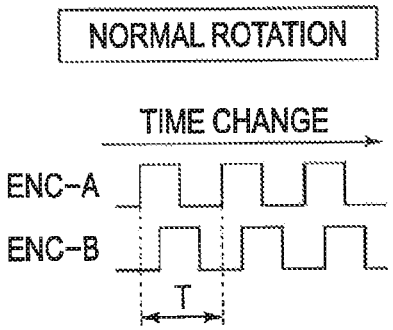
FIG. 4A is a timing chart of a waveform of an output signal when the RR motor performs normal rotation.
Figure 4B:
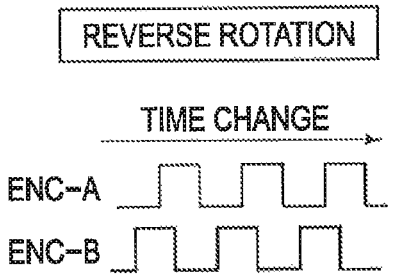
FIG. 4B is a timing chart of a waveform of an output signal when the RR motor performs reverse rotation.

FIG. 4A is a timing chart of a waveform of an output signal when the RR motor 33 performs normal rotation. FIG. 4B is a timing chart of a waveform of an output signal when the RR motor 33 performs reverse rotation. In this embodiment, using outputs from the rotary sensor 34*b*, pulse signals (an ENC signal of A phase and an ENC signal of B phase) which are out of phase from each other by 90 degrees, as shown in FIGS. 4A and 4B, are input to a control section 100. Therefore, whether the RR motor 33 is in a normal rotation state or in a reverse rotation state can be detected using the lead/retardation in phase.

The carriage driving mechanism 40 is provided with a carriage 41 which is also a portion of a component of an ink supply/ejection mechanism, a carriage shaft 42, a carriage motor (not shown), a belt, and so on.

The carriage 41 is provided with an ink tank 43 for storing ink of each color, and ink can be supplied from an ink cartridge (not shown), which is provided fixed on the front face side of the main body portion 20, to the ink tank 43 through a tube (not shown). Also, as shown in FIG. 2, a printing head 44 which can eject ink droplets is provided at the lower surface of the carriage 41. A nozzle row (not shown) correlated with each ink is provided at the printing head 44 and a piezo element (not shown) is disposed at a nozzle which constitutes the nozzle row. The ink droplet can be ejected from the nozzle which is located at an end portion of an ink path, by an operation of the piezo element.

In addition, the ink supply/ejection mechanism is constituted by the carriage 41, the ink tank 43, the tube (not shown), the ink cartridge, and the printing head 44. Also, the printing head 44 is not limited to a piezo driving method using the piezo element, but may also adopt, for example, a heater method which uses the force of a bubble that is generated by heating ink by a heater, a magnetostriction method which uses a magnetostriction element, a mist method which controls mist by an electric field, or the like. Also, ink which is filled in the ink cartridge/the ink tank 43 may also be any kind of ink such as dye-based ink or pigment-based ink.

Figure 5:
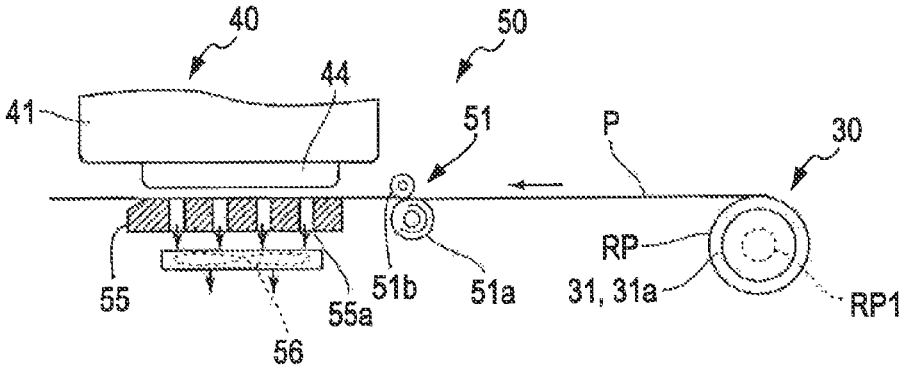
FIG. 5 is a diagram showing the positional relationship among a roll body, a transport roller pair, and a printing head.

The paper transport mechanism 50 has a transport roller pair 51, a gear wheel train 52, a PF motor (paper feed motor) 53, and a rotation detection section 54, as shown in FIGS. 2 and 5. In addition, FIG. 5 is a diagram showing the positional relationship among the roll body RP, the transport roller pair 51, and the printing head 44.

The transport roller pair 51 is provided with a transport roller 51*a* and a driven transport roller 51*b*, and a paper P (a roll paper) which is drawn from the roll body RP can be pinched by these rollers.

The PF motor 53 is to provide a driving force (a turning force) to the transport roller 51*a* through the gear wheel train 52.

In this embodiment, the rotation detection section 54 uses a rotary encoder, so that the rotation detection section is provided with a disc-shaped scale 54*a* and a rotary sensor 54*b*, similarly to the above-mentioned rotation detection section 34, and can output the pulse signals as shown in FIGS. 4A and 4B.

Also, a platen 55 is provided further on the downstream side (the paper discharge side) than the transport roller pair 51, so that the paper P is guided on the platen 55. Also, the printing head 44 is disposed so as to face the platen 55. Suction holes 55*a* are formed in the platen 55. On the other hand, the suction holes 55*a* are provided so as allow communication with a suction fan 56, so that air is sucked from the printing head 44 side through the suction holes 55*a* by an operation of the suction fan 56. By this, in a case where the paper P is present on the platen 55, the paper P can be sucked and held. In addition, the printer 10 is provided with various other sensors such as a paper width detection sensor 57 which detects the width of the paper P, or the like.

Concerning the Control Section

Figure 6:
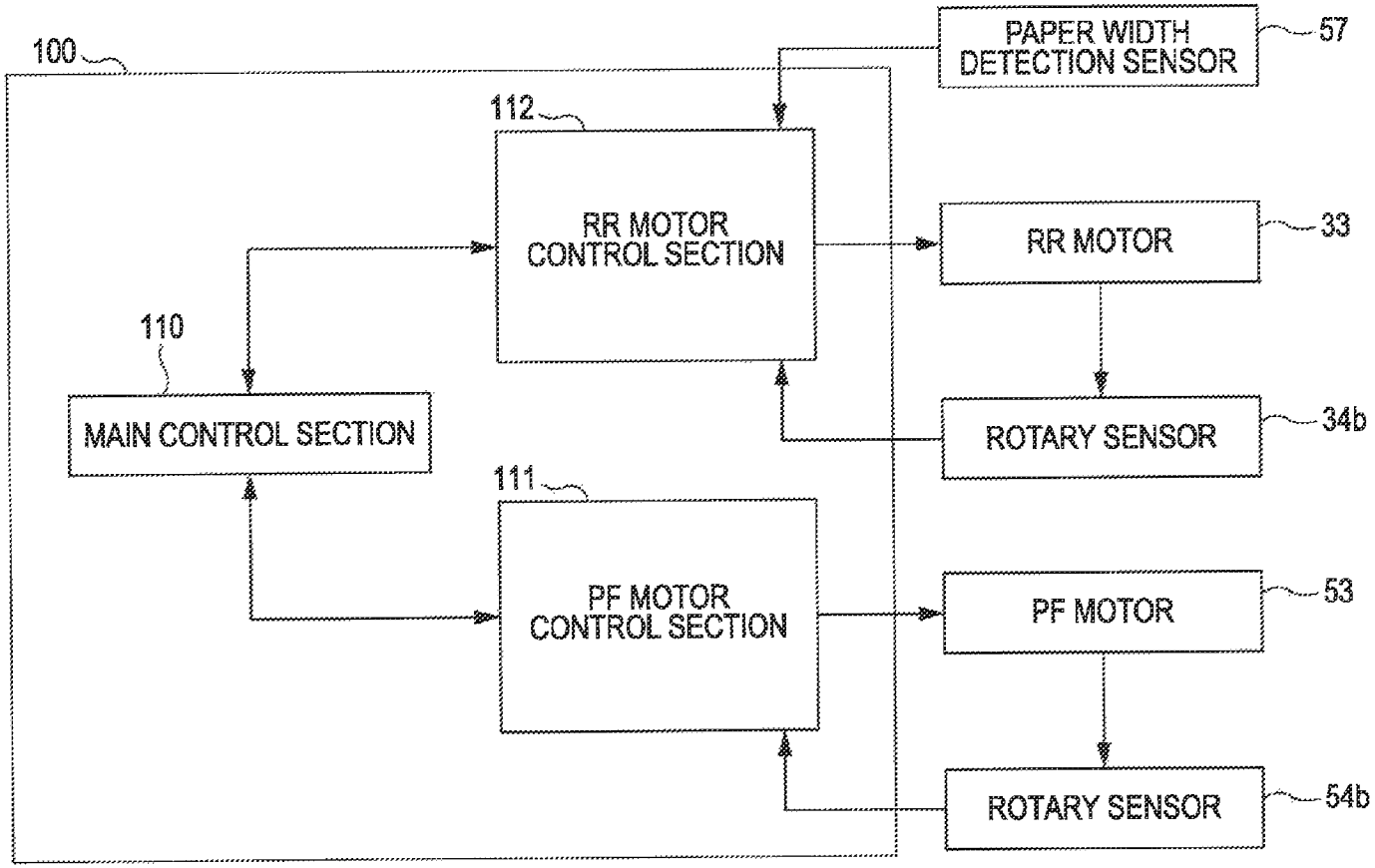
FIG. 6 is a block diagram showing a functional configuration example of a control section.

FIG. 6 is a block diagram showing a functional configuration example of the control section 100. The control section 100 is a section which performs various controls. Each of output signals of the rotary sensors 34*b* and 54*b*, the paper width detection sensor 57, a linear sensor or a gap detection sensor, which are not shown, a power switch which turns on/off an electric power supply of the printer 10, and the like is input to the control section 100. As shown in FIG. 2, the control section 100 is provided with a CPU 101, a ROM 102, a RAM 103, a PROM 104, an ASIC 105, a motor driver 106, etc., and they are interconnected through a transmission line 107 such as a bus, for example. Also, the control section 100 is connected to a computer COM. Then, a main control section 110, a PF motor control section 111, and an RR motor control section 112, which are as shown in FIG. 6, are implemented by the hardware, software which is stored in the ROM 102 or the PROM 104, and/or cooperation of data, the addition of a circuit or a component, which performs a specific processing, or the like. In addition, in this embodiment, as the PROM 104, a flash memory (a flash type EEPROM) is provided, so that writing and reading each become possible.

The PF motor control section 111 of the control section 100 controls the driving of the PF motor 53 such that the transport roller 51*a* is rotated, whereby the paper P is transported in a transport direction. In addition, in the following, the rotation direction of the PF motor 53 when transporting the paper P in the transport direction is called a normal rotation direction. The RR motor control section 112 controls the driving of the RR motor 33, thereby adjusting tension (tensile force) of the paper P. In addition, the rotation direction to wind off the paper P from the roll body is referred to as the normal rotation direction of the RR motor 33, and conversely, the rotation direction to wind up the paper is referred to as a reverse rotation direction. The main control section 110 controls operations of the PF motor control section 111 and the RR motor control section 112. The control section 100 executes each processing, which will be described later, in cooperation with the main control section 110, the PF motor control section 111, and the RR motor control section 112.

Concerning Overall Processing

Figure 7:
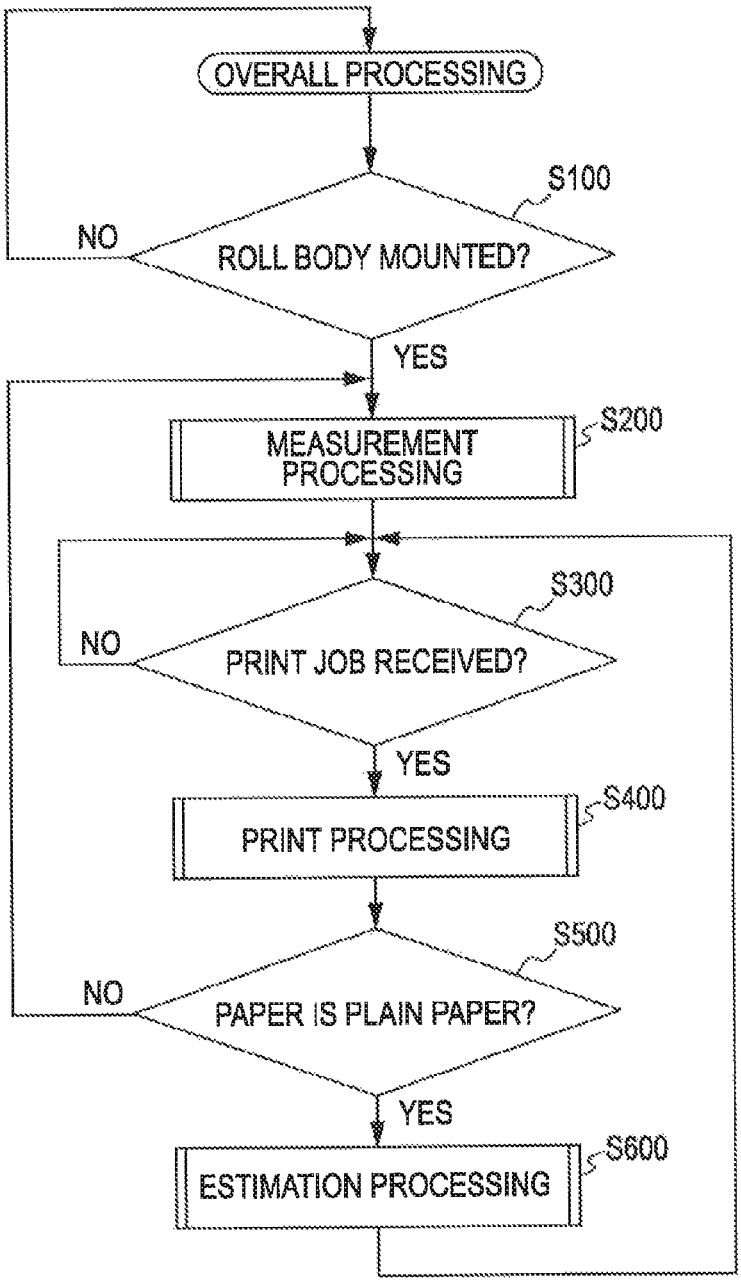
FIG. 7 is a flow chart showing the schematic flow of the overall processing which a printer of an embodiment executes.

FIG. 7 is a flow chart showing the schematic flow of the overall processing which the printer 10 of this embodiment executes. First, the control section 100 detects that the roll body RP has been mounted (exchanged) on the roll mounting portion 22 (S100). For example, the mounting of the roll body RP on the roll mounting portion 22 may also be detected by a sensor (not shown), or the mounting of the roll body RP may also be detected in response to the operation of an operation panel (not shown). In this embodiment, at the operation panel (not shown), the mounting of the roll body RP and the kind (for example, plain paper, glossy paper, mat paper) of the paper P wound on the roll body can be input. The information for identifying the kind of paper P received is stored in the PROM 104. Next, the control section 100 executes a measurement processing (S200). In the measurement processing, a diameter D of the paper P that is wound around the roll body RP just after the mounting of the roll body RP, and a roll static-load (torque) when the roll body RP rotates are measured. Since the roll static-load varies linearly in response to the rotating velocity of the roll body RP (a transport velocity V of the paper P), a roll static-load at the time of high-speed transport, Nhi, and a roll static-load at the time of low-speed transport, Nlo, are measured. If the measurement processing is finished, the roll static-loads Nhi and Nlo and the diameter D are stored in the PROM 104.

If the measurement processing is finished, a printable state is reached, and an input of a print job from the computer COM is received (S300). Then, a print processing related to the received print job is executed (S400). Then, if the print processing is finished, whether or not the paper P of the mounted roll body RP is plain paper is determined (S500), and in a case where the paper is plain paper, an estimation processing is executed (S600). In the estimation processing, the diameter D and the roll static-loads Nhi and Nlo of the roll body RP just after the print processing are acquired, and these are updated in the PROM 104. If the estimation processing is finished, the process returns to Step S300. On the other hand, in Step S500, in a case where the paper P of the mounted roll body RP is not plain paper, the process returns to Step S200, thereby executing the measurement processing. That is, by the measurement processing, the roll static-loads Nhi and Nlo and the diameter D are acquired and updated in the PROM 104.

As described above, in this embodiment, in the stage where the roll body RP is mounted, the measurement processing is executed, and every time the print processing is completed, the roll static-loads Nhi and Nlo and the diameter D stored in the PROM 104 are updated. However, in a case where the paper P of the mounted roll body RP is plain paper, the roll static-loads Nhi and Nlo and the diameter D are acquired by the measurement processing the first time, and for the second time and thereafter, the roll static-loads Nhi and Nlo and the diameter D are acquired by the estimation processing. On the other hand, in a case where the paper P of the mounted roll body RP is not plain paper, the roll static-loads Nhi and Nlo and the diameter D are acquired by the measurement processing each time. In addition, there is a case where the printer 10 also transports the paper P in a processing other than the print processing. For example, a case where the paper P is transported at the time of maintenance can also be considered. Also in a case where such an operation is performed, in order to update the roll static-loads Nhi and Nlo and the diameter D, it is desirable to execute the measurement processing or the estimation processing.

Concerning the Measurement Processing

Next, the measurement processing will be explained.

Figure 8:
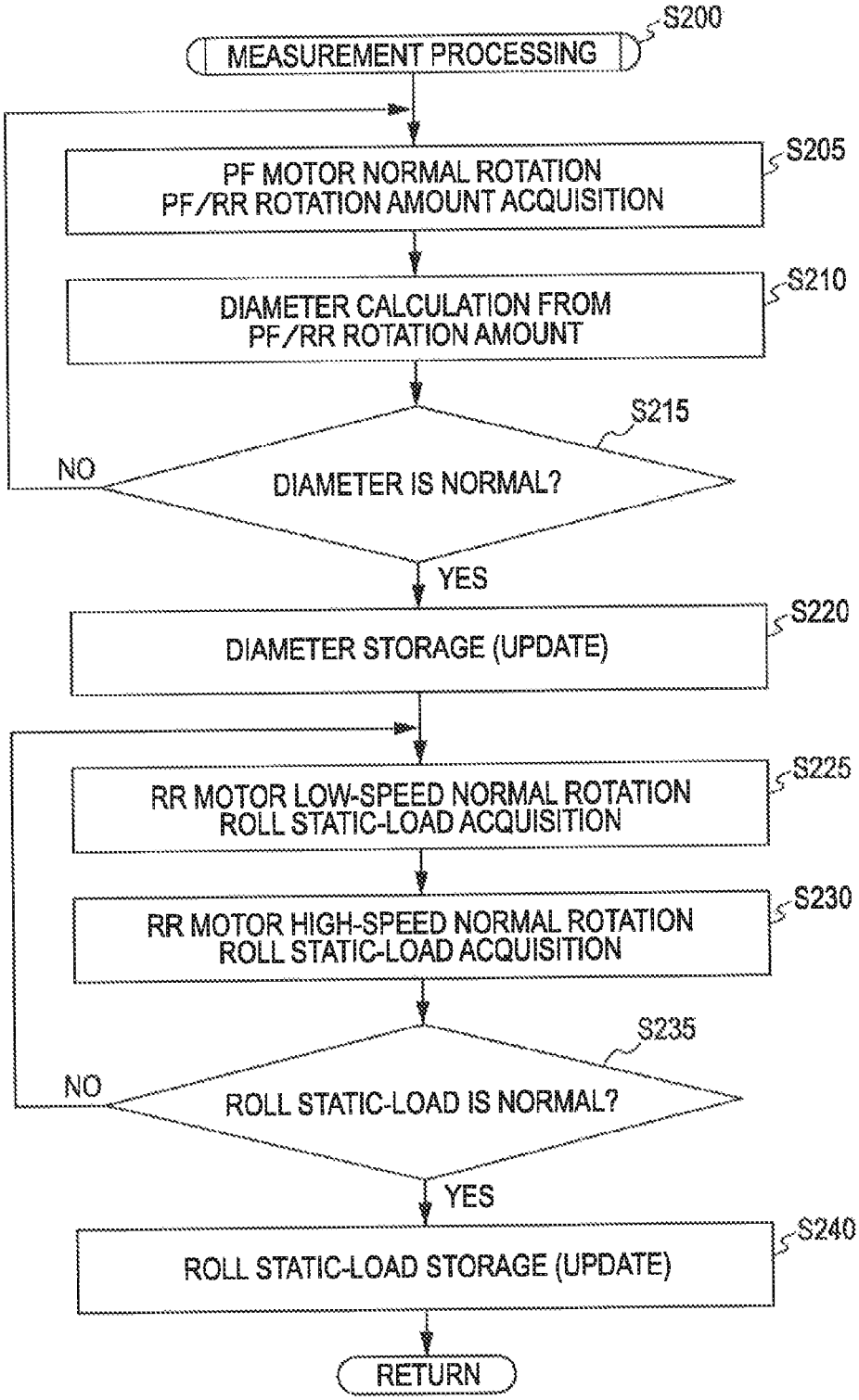
FIG. 8 is a flow chart showing the flow of a measurement processing.

FIG. 8 is a flow chart showing the flow of the measurement processing. First, by driving the PF motor 53 in the normal rotation direction by the PF motor control section 111, the control section 100 acquires the outputs from the rotary sensors 34*b* and 54*b* (S205). Only the PF motor 53 is driven in the normal rotation direction. However, since the paper P of the roll body RP is transported in response to the driving of the PF motor 53, the roll body RP and the RR motor 33 also rotate in the normal rotation direction depending on the transport.

Figure 9:
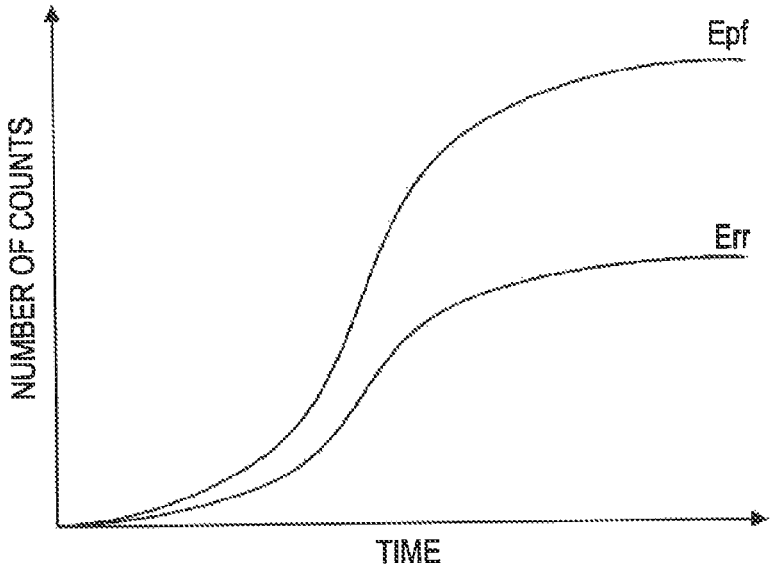
FIG. 9 is a diagram showing one example of an output of a rotary sensor.

FIG. 9 shows one example of the outputs of the rotary sensors 34*b* and 54*b* in Step S205. In this drawing, a broken line represents an output of the rotary sensor 54*b* with respect to the rotation amount of the PF motor 53, and a solid line represents an output of the rotary sensor 34*b* with respect to the rotation amount of the RR motor 33. The horizontal axis represents time, and the vertical axis represents the numbers of counts, Err and Epf, of the rotary sensors 34*b* and 54*b*. The Err and Epf are the numbers of counts of the edges of the above-mentioned ENC signals and mean the rotation amounts of the rotary sensors 34*b* and 54*b* in Step S205. As shown in FIG. 9, the PF motor 53 is driven so as to be accelerated over the period from the early period to the middle period, then, gradually decelerate, and eventually stop. Since the RR motor 33 is driven, the output of the rotary sensor 34*b* is also the same.

Then, after the lapse of a predetermined period of time from the driving in Step S205, the respective numbers of counts, Err and Epf, of the rotary sensors 34*b* and 54*b* are acquired and the diameter D is calculated on the basis of the numbers of counts (S210). Here, if the stretching or the slippage of the paper P is to be nearly negligible, the amount of transport ΔLpf of the paper P which is transported by the rotation of the PF motor 53 in Step S205 and the amount of transport ΔLrr of the paper P which is transported by the rotation of the RR motor 33 can be considered to be equal to each other. Further, the amounts of transport, ΔLpf and ΔLrr, of the paper P are proportional to the respective numbers of counts, Err and Epf, of the rotary sensors 34*b* and 54*b*. If these proportionality coefficients are respectively defined as k1 and k2, the following expressions (1) to (3) are established.

$$\Delta Lpf = k1 \times Epf \tag{1}$$

$$\Delta Lrr = k2 \times Err \tag{2}$$

$$\Delta Lpf = \Delta Lrr \tag{3}$$

The proportionality coefficient k1 related to the PF motor 53 is a constant which corresponds to a reduction gear ratio of the gear wheel train 52 or the diameter or the circumference ratio of the transport roller 51*a*. On the other hand, since the diameter D is reduced in accordance with the transport of the paper P, the proportionality coefficient k2 related to the RR motor 33 is a coefficient which is proportional to the diameter D. If the proportionality coefficient k2 is divided into a constant k3 (a constant corresponding to the reduction gear ratio of the gear wheel train 52 or the circumference ratio) and the diameter D, the above-mentioned expressions can be expressed as follows:

$$\Delta Lrr = k3 \times D \times Err \tag{4}$$

$$k1 \times Epf = k3 \times D \times Err \tag{5}$$

The control section 100 determines whether or not the calculated diameter D is a normal value (S215), and in a case where it is normal, the diameter D is stored in the PROM 104 (S220). In a case where it is not normal, Step S205 is executed again. Also, in a case where it is not normal, the process may also be finished while issuing an error notification.

Then, the RR motor control section 112 drives the RR motor 33 in the normal rotation direction, thereby feeding the paper P at a certain transport velocity Vlo (S225). Further, in Step S225, while the transport velocity V of the paper P is stable at the transport velocity Vlo, the control section 100 acquires the roll static-load Nlo by converting a Duty value of a PWM signal that the RR motor control section 112 outputs to the RR motor 33, into torque. In this embodiment, PID control which targets the transport velocity Vlo is performed, so that the roll static-load Nlo is acquired by converting an average value of integral components of the PID control into torque. In addition, since the transport velocity V of the paper P can be obtained by dividing the above-mentioned amount of transport, ΔLrr, by time, the PID control which targets the transport velocity Vlo can be performed.

Thereafter, the RR motor control section 112 drives the RR motor 33 in the normal rotation direction, thereby feeding the paper P at a certain transport velocity Vhi (>Vlo). Then, while the transport velocity V of the paper P is stable at the transport velocity Vhi, the control section 100 acquires the roll static-load Nhi by converting the Duty value of the PWM signal that the RR motor control section 112 outputs to the RR motor 33, into torque, similarly to Step S225, (S230). Here, the roll static-loads Nlo and Nhi can be considered to be values corresponding to loads required to rotate the roll body RP at the rotating velocities corresponding to the transport velocities Vlo and Vhi against rotational resistance (mainly frictional resistance).

Figure 10:
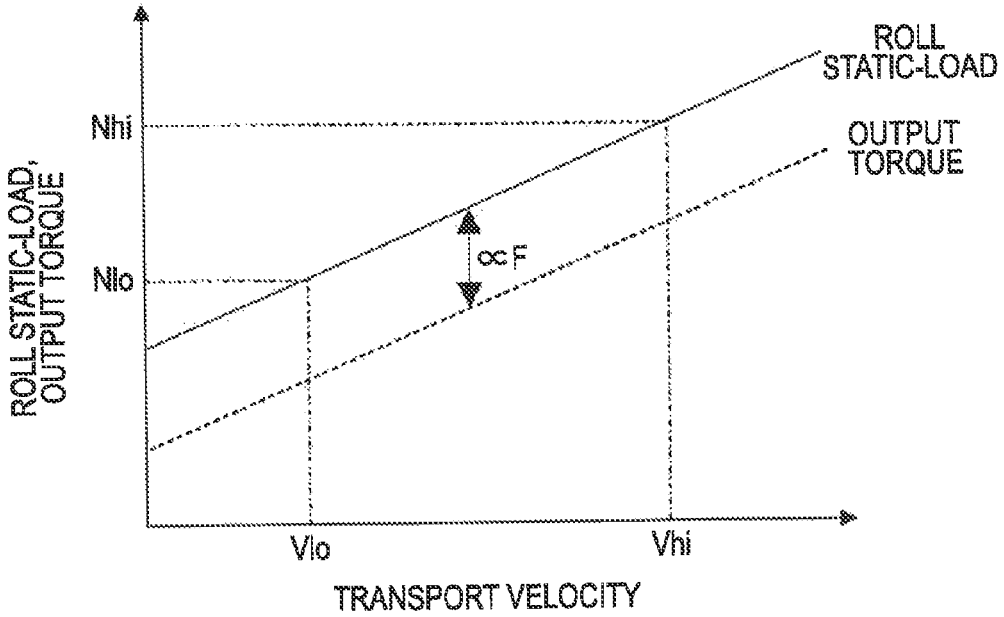
FIG. 10 is a diagram showing one example of the relationship between a transport velocity V and a roll static-load N.

FIG. 10 shows one example of the relationship between an arbitrary transport velocity V and a roll static-load N. As shown in this drawing, the roll static-load N can be expressed by a linear function of the transport velocity V, and if at least the roll static-loads Nlo and Nhi for the transport velocities Vlo and Vhi are known, the roll static-load corresponding to an arbitrary transport velocity V can be calculated by the following expression (6).

$$N = \frac{(Nhi - Nlo)}{(Vhi - Vlo)} V + \left\{ Nlo - \frac{(Nhi - Nlo)}{(Vhi - Vlo)} Vlo \right\} \tag{6}$$

The control section 100 determines whether or not the values of the roll static-loads Nlo and Nhi are normal (S235), and in a case where they are normal, the roll static-loads Nlo and Nhi are stored in the PROM 104 (S240), and then the measurement processing is completed. In a case where they are not normal, the process is executed again from Step S225. According to the measurement processing described above, the diameter D and the roll static-loads Nlo and Nhi can be measured and stored in the PROM 104. In addition, as described above, in a case where the paper P of the roll body RP is not plain paper, the measurement processing is executed for every execution of the print processing, so that the diameter D and the roll static-loads Nlo and Nhi are sequentially updated.

Concerning the Estimation Processing

Next, the estimation processing will be explained.

Figure 11:
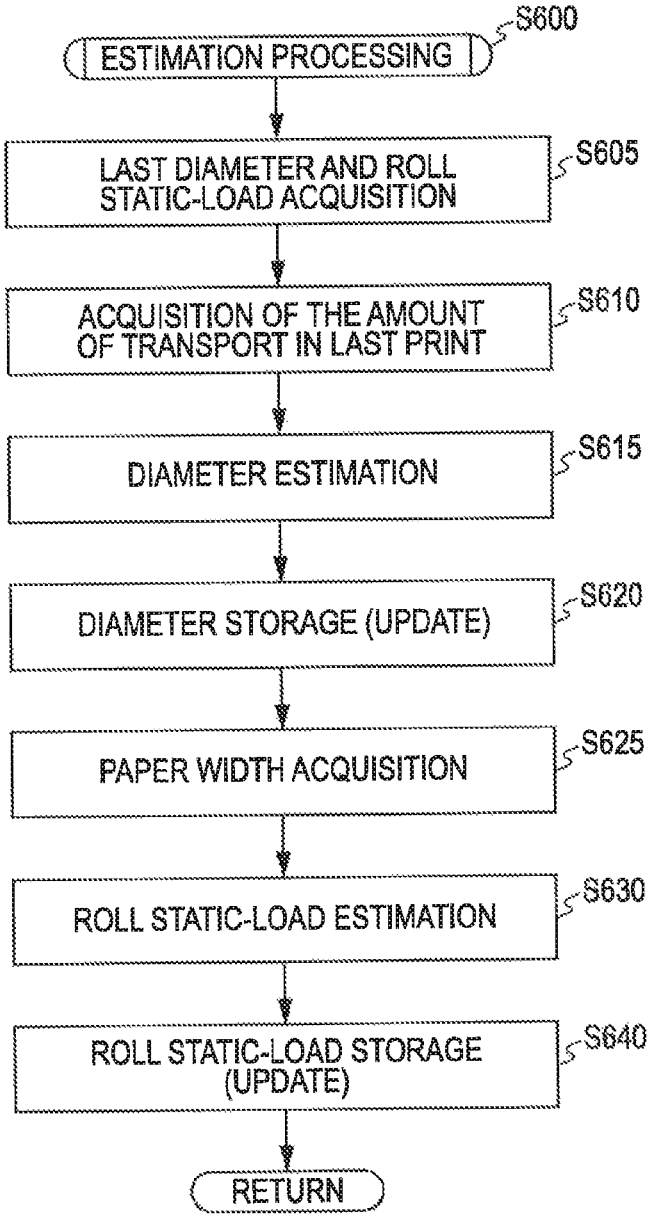
FIG. 11 is a flow chart showing the flow of an estimation processing.

FIG. 11 is a flow chart showing the flow of the estimation processing.

First, the control section 100 acquires the diameter D, which is currently stored in the PROM 104 (S605). In addition, the diameter D, which is currently stored in the PROM 104, means the diameter D (hereinafter referred to as a reference diameter D0) of the paper P that is wound around the roll body RP before the execution of the last print processing. In addition, as shown in FIG. 7, the condition of the execution of the estimation processing is based on the premise that the paper P of the roll body RP is plain paper.

Thereafter, the control section 100 acquires the amount of transport ΔL (ΔLpf) of the paper P transported in the last print processing (S610). Since in each printing job, a print size in the transport direction is designated, the amount of transport ΔL actually transported in the print processing can be acquired. Of course, a cumulative total value of the number of counts of the rotary sensor 54*b* in the print processing may also be converted into the amount of transport ΔLpf by the above-mentioned expression (1). Then, on the basis of the correspondence relationship between the diameter D and the remaining amount L of the paper P which is wound on the roll body RP, the current diameter D is estimated (S615).

Figure 12:
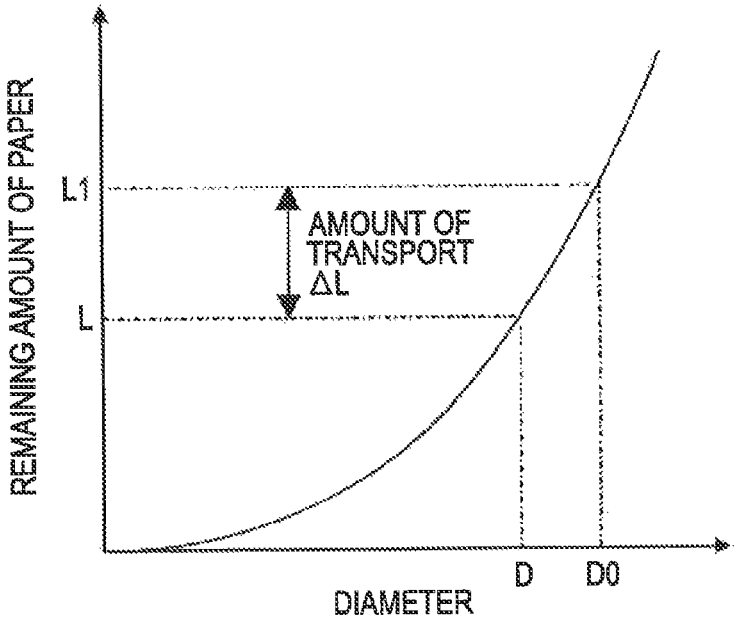
FIG. 12 is a diagram showing an example of the correspondence relationship between a diameter D and a remaining amount L.

FIG. 12 is a diagram showing an example of the correspondence relationship between the above-mentioned diameter D and the remaining amount L. In this drawing, the vertical axis represents the remaining amount L of the paper P which is wound on the roll body RP, and the horizontal axis represents the diameter D. As shown in this drawing, the remaining amount L can be expressed by a parabola (quadratic function) of the diameter D. In the estimation of the current diameter D, first, the remaining amount L (hereinafter referred to as a reference remaining amount L1) of the paper P, which corresponds to the reference diameter D0 before the execution of the last print processing, which has been acquired in Step S605, is calculated on the basis of the correspondence relationship in the drawing. Then, the remaining amount L (hereinafter referred to as a remaining amount L2) of the current paper P is calculated by subtracting the amount of transport ΔL acquired in Step S610, from the reference remaining amount L1. Further, the diameter D corresponding to the remaining amount L2 of the current paper P is calculated on the basis of the correspondence relationship in the drawing. By this, the current diameter D can be estimated. In addition, function parameters which define the correspondence relationship (quadratic function) in the drawing are stored in advance in the ROM 102, and the parameters are read and used in Step S615.

The control section 100 updates and stores the diameter D estimated in this manner, in the PROM 104 (S620).

Next, the control section 100 acquires a measured value w of the paper width by the paper width detection sensor 57 (S625). Then, on the basis of the correspondence relationship between the diameter D and the roll static-loads Nlo and Nhi, the roll static-loads Nlo and Nhi in a case where the current roll body RP is rotated at the rotating velocities corresponding to the transport velocities Vlo and Vhi are estimated (S630).

Figure 13A:
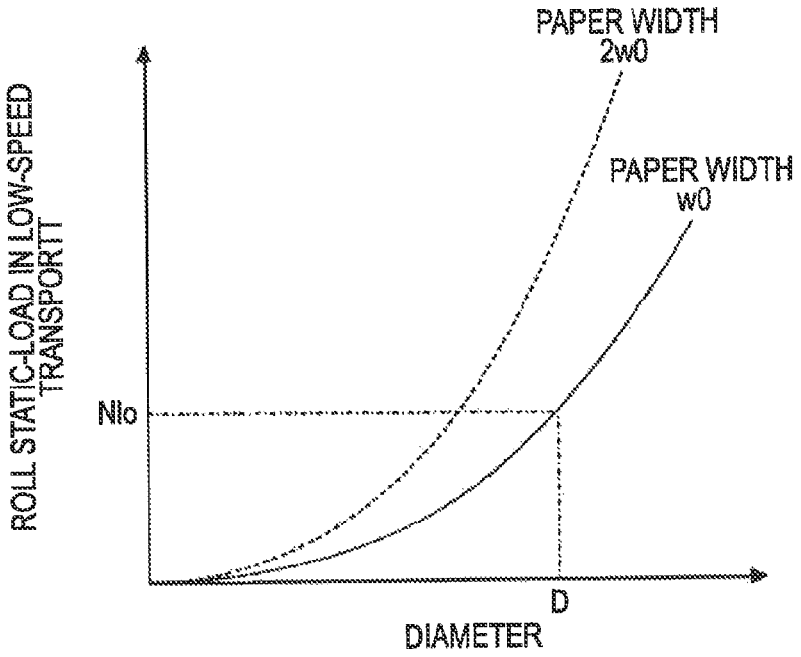
FIGS. 13A and 13B are diagrams showing the correspondence relationship between the roll static-load N and the diameter D of the medium that is wound around the roll body.
Figure 13B:
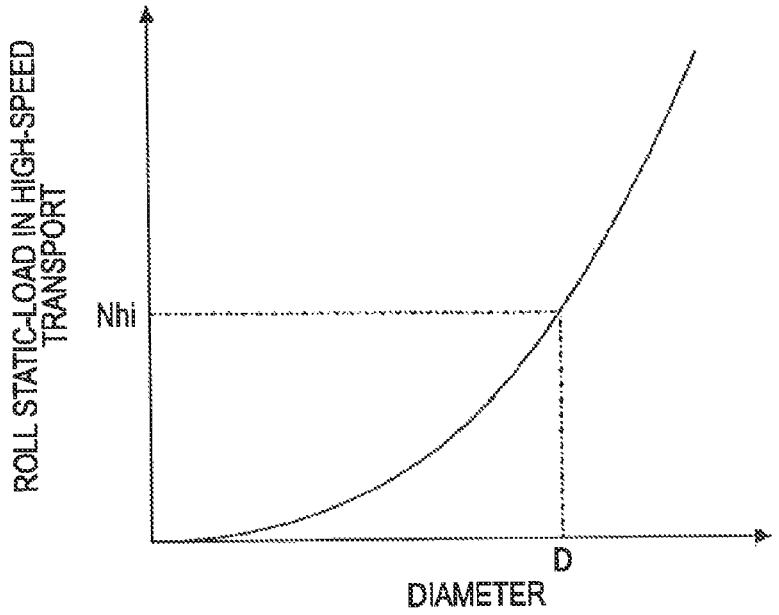

FIGS. 13A and 13B are diagrams showing the correspondence relationship between the roll static-load N and the diameter D. In these drawings, the vertical axis represents the roll static-loads N (Nlo and Nhi), and the horizontal axis represents the diameter D. In these drawings, the roll static-loads Nlo and Nhi in a case where the roll body RP in which the paper P of a reference paper width w0 is wound is driven at the transport velocities Vlo and Vhi, respectively, are shown by a sold line. As shown in these drawings, the roll static-load N can be expressed by a parabola (quadratic function) of the diameter D. This is because the weight of the roll body RP is reduced in accordance with a reduction in the diameter D, so that a frictional resistance is relieved.

Also, the roll static-loads Nlo and Nhi can be considered to be proportional to the paper width w. For example, in the case of a paper width W twice the reference paper width w0, there is a static load of twice the magnitude as shown by a broken line in the roll static-load Nlo. In the case of seeking out the roll static-loads Nlo and Nhi of an arbitrary paper width w, it is preferable if a paper width ratio w/w0 is multiplied by the roll static-loads Nlo and Nhi which are shown by a solid line. Since the current diameter D has been acquired in Step S615, in Step S630, in the correspondence relationship in the drawings, the roll static-loads Nlo and Nhi (the solid lines) which correspond to the diameter D are respectively calculated. Further, by multiplying by the above-mentioned paper width ratio w/w0, the roll static-loads Nlo and Nhi related to the actual paper width w can be estimated. The control section 100 updates and stores the roll static-loads Nlo and Nhi estimated as above, in the PROM 104 (S640).

The above-mentioned correspondence relationships (FIGS. 12, 13A, and 13B) are prepared on the basis of a logical expression or a preliminary experiment. However, in this embodiment, the preparation is made only with respect to plain paper. Therefore, only in a case where the paper P of the mounted roll body RP is plain paper, is the estimation by the estimation processing possible. In the case of performing the printing on plain paper, since demand to shorten the time for printing is great, in this embodiment, by performing the estimation processing with respect to plain paper, the shortening of the time required for printing is attained. Of course, a configuration may also be made such that with respect to glossy paper or mat paper, the above-mentioned correspondence relationships are prepared and the estimation processing is performed by using the correspondence relationship according to the kind of mounted paper P.

Also in the case where the measurement processing has been performed, or also in the case where the estimation processing has been performed, the diameter D and the roll static-loads Nhi and Nlo of the current roll body RP after the execution of the print processing can be obtained. Also, the diameter D and the roll static-loads Nhi and Nlo of the current (latest) roll body RP can be stored in the PROM 104, and the print processing which will be described later is executed by using these.

Concerning the Print Processing

Next, the print processing will be explained.

Figure 14:
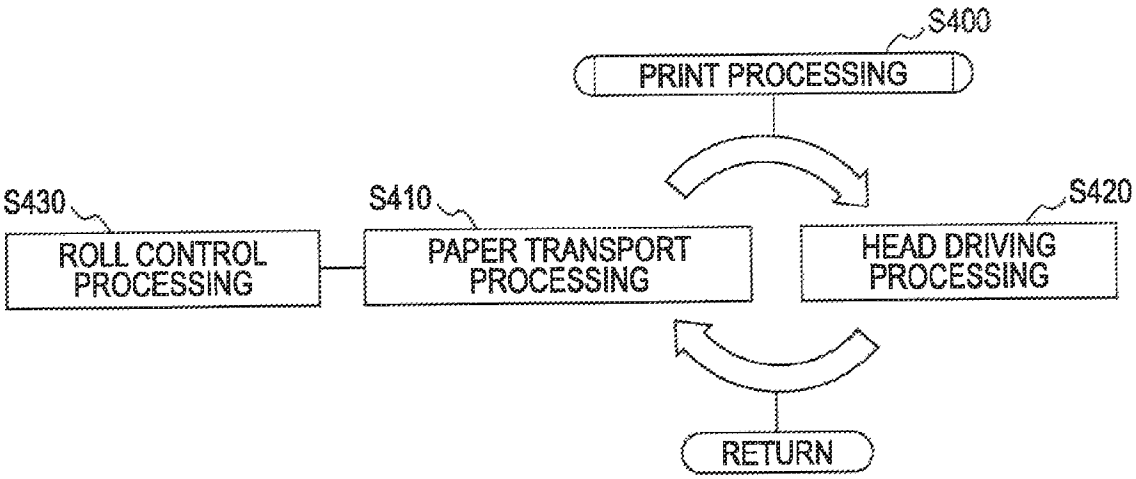
FIG. 14 is a diagram showing the flow of a print processing.

FIG. 14 is a diagram showing the flow of the print processing. As shown in this drawing, the print processing is performed by alternately repeating a paper transport processing (S410) and a head driving processing (S420).

In the paper transport processing (S410), the PF motor control section 111 of the control section 100 controls the driving of the PF motor 53 so as to rotate the transport roller 51*a*, thereby transporting the paper P in the transport direction. In each paper transport processing, the length (corresponding to the above-mentioned amount of transport ΔL; hereinafter referred to as a target amount of transport ΔLt) of the paper P to be transported is designated, and the driving control for transporting the paper by the target amount of transport ΔLt is performed with respect to the PF motor 53.

On the other hand, in the head driving processing (S420), ink droplets are discharged from a plurality of nozzles provided at the printing head 44 while scanning the printing head 44 in the direction perpendicular to the transport direction of the paper P in a state where the paper P is at rest. By this, ink dots can be formed on the paper P.

By alternately performing the paper transport processing the head driving processing, ink dots can be disposed in a two-dimensional direction, so that a planar image can be printed on the paper P. If all the paper transport processing and the head driving processing is finished, the process returns to the main flow shown in FIG. 7, and then the measurement processing (in the case of paper other than plain paper) or the estimation processing (in the case of plain paper) is executed. Incidentally, in this embodiment, a roll control processing is executed along with each paper transport processing (Step S410). The roll control processing (Step S430) is described below.

Concerning the Roll Control Processing

As described above, since the paper transport processing is performed alternating with the head driving processing, the driving of the PF motor 53 is intermittently performed. The above-mentioned roll control processing is executed in synchronization with each driving (the stopping—the driving—the stopping) of the PF motor 53. That is, the RR motor 33 is also intermittently driven, similarly to the PF motor 53.

Figure 15:
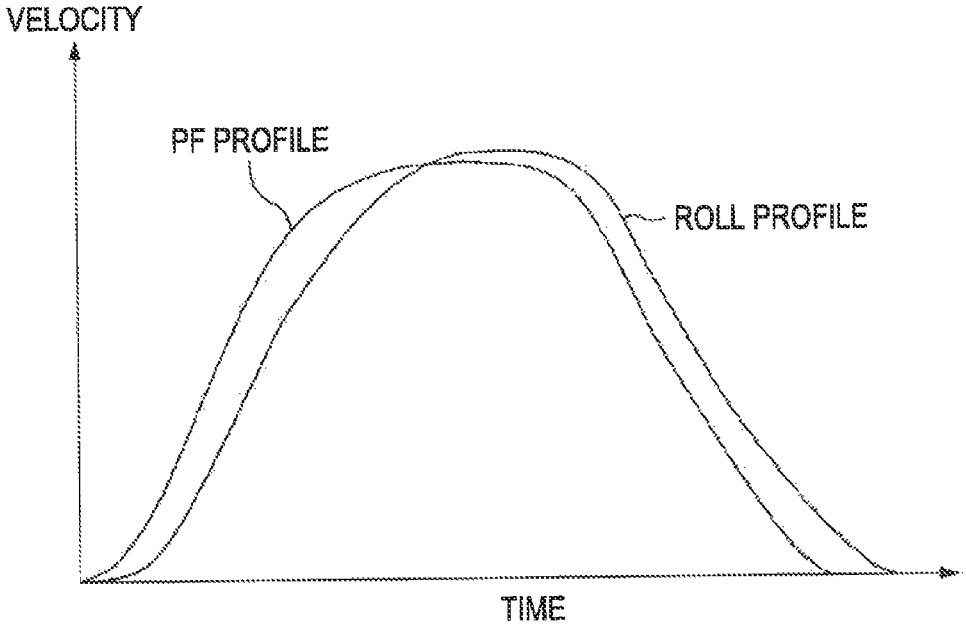
FIG. 15 is a diagram showing the relationship between a velocity profile of a PF motor and a velocity profile of the RR motor.

FIG. 15 is a diagram showing the relationship between a velocity profile of the PF motor 53 and a velocity profile of the RR motor 33. In addition, FIG. 15 shows the velocity profiles when transporting the paper P by ΔLt in each paper transport processing. In FIG. 15, the vertical axis represents a velocity, and the horizontal axis represents time. As shown in FIG. 15, the PF motor 53 and the RR motor 33 are driven so as to be varied in the order of acceleration, constant velocity, and deceleration. However, the RR motor 33 is made to be driven somewhat behind the driving of the PF motor 53. By doing so, a tensile force (tension) of the paper P between the transport roller 51*a* and the roll body RP is adjusted.

In the roll control processing, the RR motor control section 112 changes the Duty value of the PWM signal in PWM control, thereby applying a voltage (effective voltage) corresponding to the Duty value to the RR motor 33. In this way, the RR motor 33 is driven on the basis of a roll profile. By performing the PWM control in this manner, electric power which is supplied to the RR motor 33 can be accurately and easily controlled.

In addition, before the explanation of the roll control processing; first, a processing (assistance) which is performed at the time of the start of the driving of the RR motor 33 will be explained.

Concerning the Assistance

Figure 16:
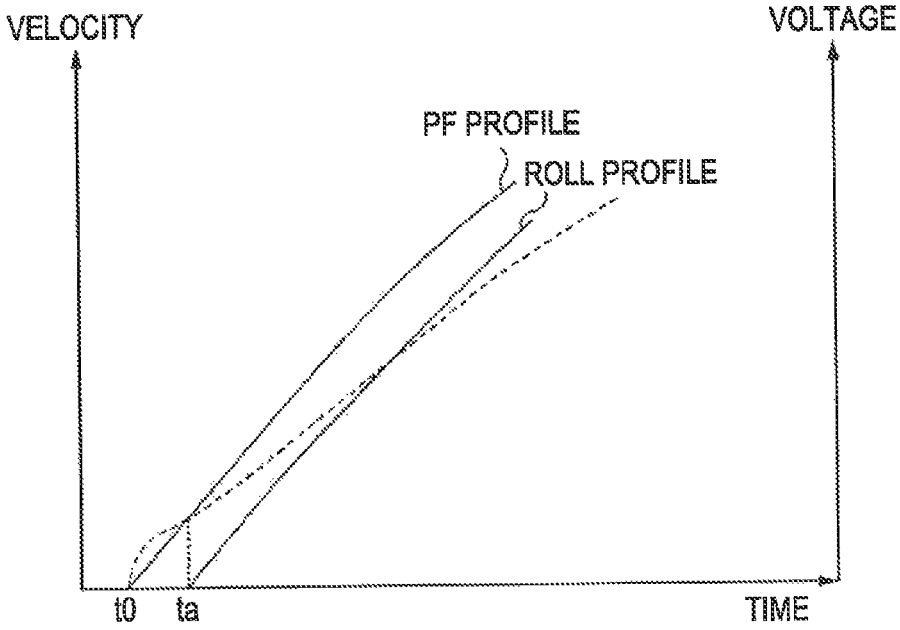
FIG. 16 is a diagram showing the relationship between the velocity profile and an applied voltage to the RR motor.

FIG. 16 is a diagram showing the relationship between the velocity profiles and an applied voltage to the RR motor 33. In addition, FIG. 16 is an enlarged view of the first place of the acceleration portion of FIG. 15. In FIG. 16, the vertical axis on the left represents a velocity, and the vertical axis on the right represents a voltage (effective voltage). Also, the horizontal axis represents time. Also, in this drawing, a broken line shows the applied voltage to the RR motor 33.

As shown in the drawing, at time t0, the application of a voltage to the RR motor 33 is started nearly simultaneously with the start of a PF profile (that is, the application of a voltage to the PF motor 53). This is because the roll body RP has its own weight, so that the roll body cannot be rotated immediately from a rest state. In addition, in order to move the roll body RP from a rest state, a force larger than that at the time of the rotation of the roil body RP is required. Therefore, in this embodiment, as shown in the drawing, electric power which is supplied at the time of the start of the driving of the RR motor 33 is set to be larger, thereby aiding (assisting) the driving of the RR motor 33. By this assistance, the RR motor 33 can be easily driven when moving the roll body RP from a rest state (when starting the feeding of the paper P).

Thereafter, if the RR motor 33 starts moving (if the motor has some velocity) at time ta, the assistance is lost, and the applied voltage to the RR motor 33 is gradually increased. By this, the rotating velocity of the RR motor 33 is increased (accelerated).

Figure 17:
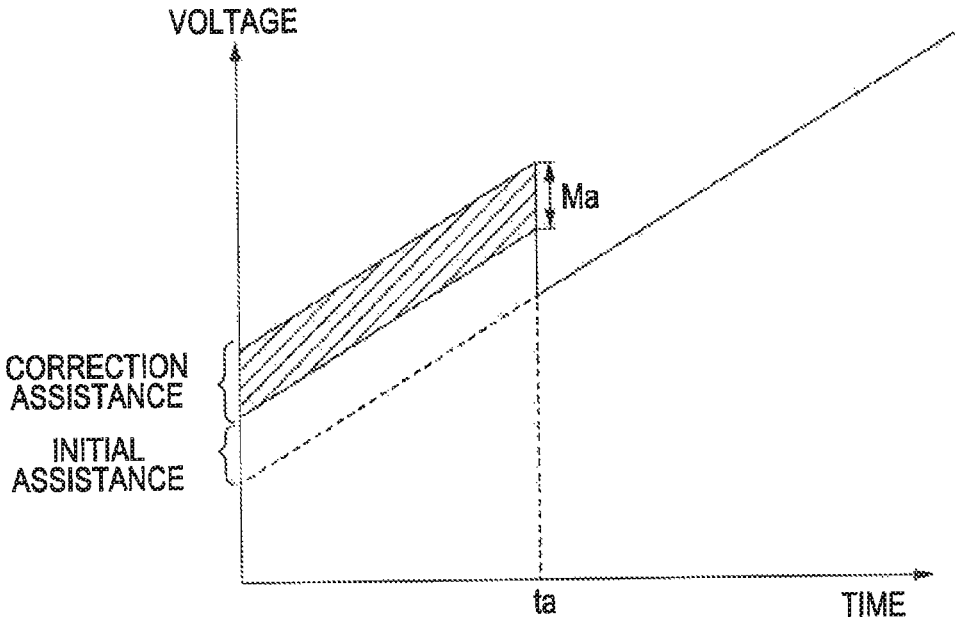
FIG. 17 is an explanatory diagram of assistance in the embodiment.

FIG. 17 is an explanatory diagram of the assistance in this embodiment. In addition, FIG. 17 shows in detail a rising edge portion of the broken line of FIG. 16. In FIG. 17, the horizontal axis represents time, and the vertical axis represents the applied voltage (effective voltage) to the RR motor 33. Also, the time ta in the drawing is the time when the RR motor 33 starts moving (when the motor is rotated at some velocity).

As shown in the drawing, initial assistance and correction assistance are added to the applied voltage to the RR motor 33 until the time to when the RR motor 33 starts moving.

The initial assistance is to add a certain voltage to the applied voltage to the RR motor 33 regardless of the diameter of the paper P that is wound around the roll body RP at the time of the driving of the RR motor 33. In other words, it is to add certain electric power to electric power which is supplied to the RR motor 33. In addition, the electric power by the initial assistance is equivalent to first assistance power.

However, in a case where the paper P of the roll body RP is a slippery medium (for example, a film-like member), as will be described later, the smaller the diameter of the paper P that is wound around the roll body RP, the more easily slippage (slip) is generated. In this case, the slippage cannot be prevented only by the initial assistance.

Figure 18A:
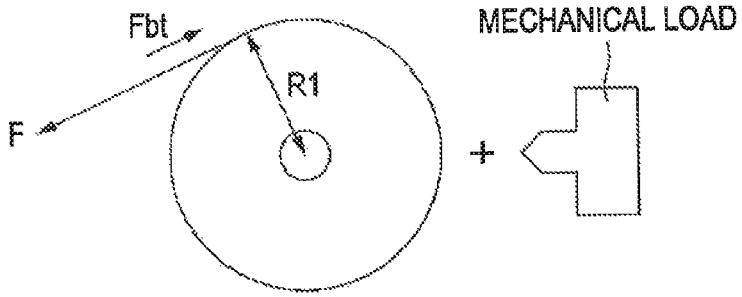
FIGS. 18A and 18B are conceptual diagrams for explaining the relationship between the diameter of the medium that is wound around the roll body and slippage.
Figure 18B:
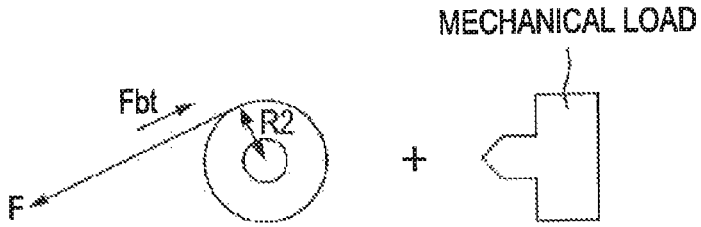

FIGS. 18A and 18B are conceptual diagrams for explaining the relationship between the diameter of the paper P that is wound around the roll body RP and the slippage. FIG. 18A shows when the radius of the paper P that is wound around the roll body RP is R1, and FIG. 18B shows when the radius of the paper P that is wound around the roll body is R2 (<R1). In addition, a mechanical load is a rotational resistance or the like of the rotating holder 31, for example, and a, load of a value which is not related to the diameter of the paper P that is wound around the roll body RP.

In a case where the paper P of the roll body RP is drawn in an arrow direction by a force of F, a force (hereinafter referred to as Fbt) of the opposite direction to F is generated. When the radius of the paper P that is wound around the roll body RP is R (=D/2), the Fbt is as follows:

$$Fbt = \text{mechanical load}/R$$

Since the mechanical load is constant regardless of the diameter of the paper P that is wound around the roll body RP, the smaller the radius R, the larger the Fbt becomes. For example, in the case shown in FIGS. 18A and 18B, the Fbt is larger when the radius is R2 than when the radius is R1. Therefore, the slippage is easily generated when the radius is R2 (that is, when the radius is smaller).

Therefore, in this embodiment, the magnitude of the assistance is corrected in accordance with the diameter of the paper P that is wound around the roll body RP by applying correction assistance. Specifically, an output voltage (Ma shown in FIG. 17) of the correction assistance is set to be in inverse proportion to the diameter (the radius R or the diameter D) of the paper P that is wound around the roll body RP. That is, when the diameter of the paper P that is wound around the roll body RP is larger, the Ma is set to be smaller, and when the diameter of the paper P that is wound around the roll body RP is smaller, the Ma is set to be larger. In the case of using a slippery medium, by applying the correction assistance in addition to the initial assistance, a slippage amount can be reduced, so that transport precision can be increased. Accordingly, deterioration of image quality can be prevented. In addition, electric power by the correction assistance is equivalent to second assistance power.

Figure 19:
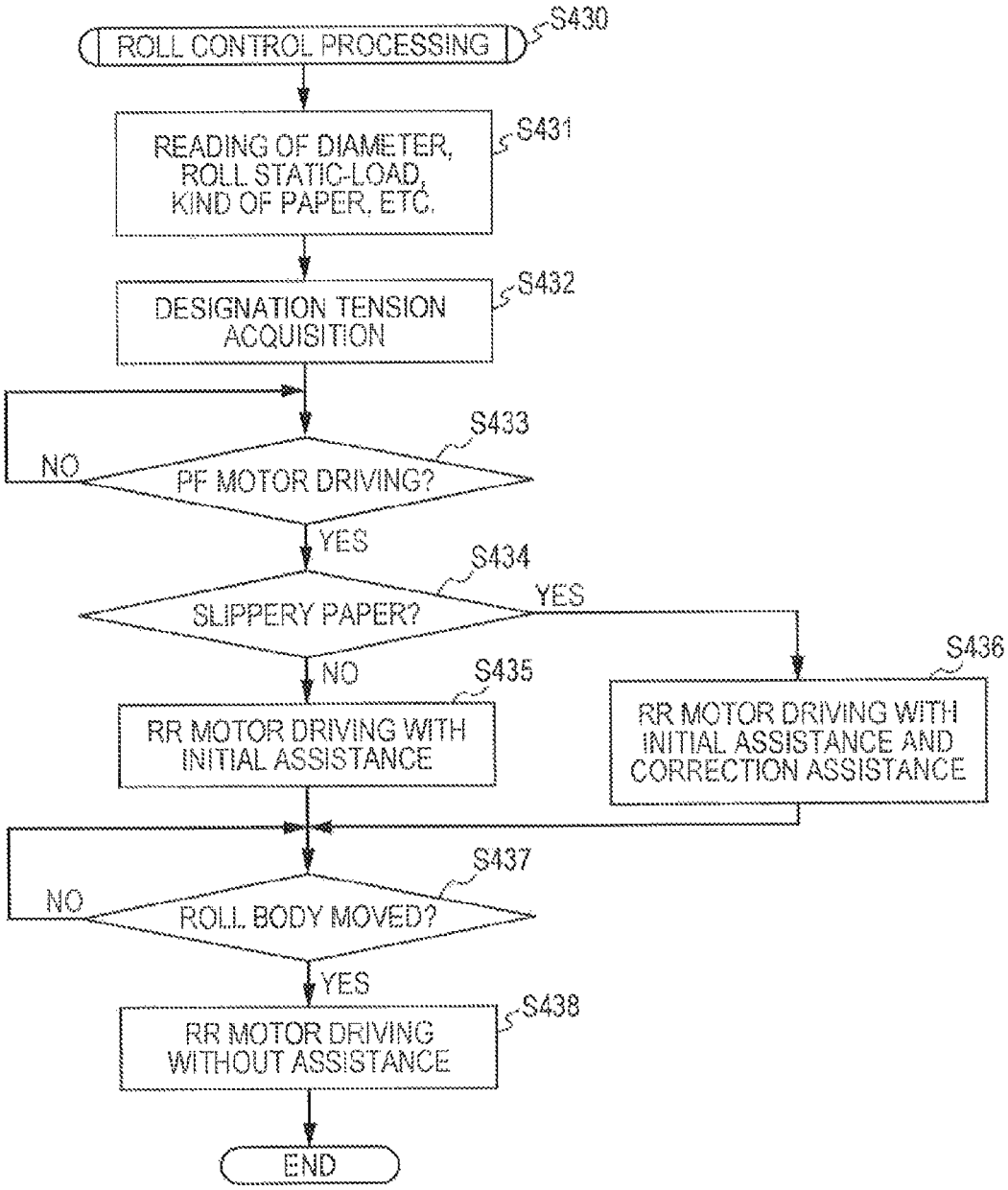
FIG. 19 is a flow chart showing the flow of a roll control processing in the embodiment.

FIG. 19 is a flow chart showing the flow of the roll control processing in the embodiment.

If the roll control processing is started, first, the RR motor control section 112 reads the diameter D of the roll body RP, the roll static-loads Nlo and Nhi, and the kind of the paper P from the PROM 104 (S431). That is, the RR motor control section acquires the diameter D of the paper P that is wound around the roll body RP just before the print processing which is being currently executed, the roll static-loads Nlo and Nhi, and the kind of the paper P. Also, the RR motor control section 112 acquires designation tension F corresponding to the kind of the paper P which has been acquired in Step S431 (S432). Strictly, unit designation tension f per a unit width is acquired, and by multiplying the unit designation tension f by a paper width w, the designation tension F(=f×w) is acquired.

The RR motor control section 112 determines whether or not the PF motor 53 has been driven (S433), and if it is determined that the PF motor 53 has been driven, the RR motor control section determines whether or not the kind of the paper P which has been acquired in the above-mentioned Step S431 is a slippery paper (S434). In this embodiment, plain paper is set to be a reference, and a paper (for example, a film-like member) more slippery than the plain paper is defined as a slippery paper.

If it is determined that the kind of the paper P which has been acquired is not a slippery paper (NO in S434), the RR motor control section 112 starts the driving of the RR motor 33 by adding the initial assistance to the electric power for driving the RR motor 33 according to a normal velocity profile (roll profile) (S435).

On the other hand, in Step S434, if it is determined that the kind of the paper P which has been acquired is a slippery paper (YES in S434), the RR motor control section 112 drives the RR motor 33 by adding the initial assistance and the correction assistance to the electric power for driving the RR motor 33 according to a normal velocity profile (roll profile) (S436). By this, the smaller the diameter of the paper P that is wound around the roll body RP, the larger the electric power which is supplied to the RR motor 33 becomes.

After Step S435 and Step S436, the RR motor control section 112 determines whether or not the roll body RP has started moving (S437). If it is determined that the roll body RP has started moving, the RR motor control section drives the RR motor 33 on the basis of the velocity profile (the roll profile) without the assistance (S438).

Figure 20:
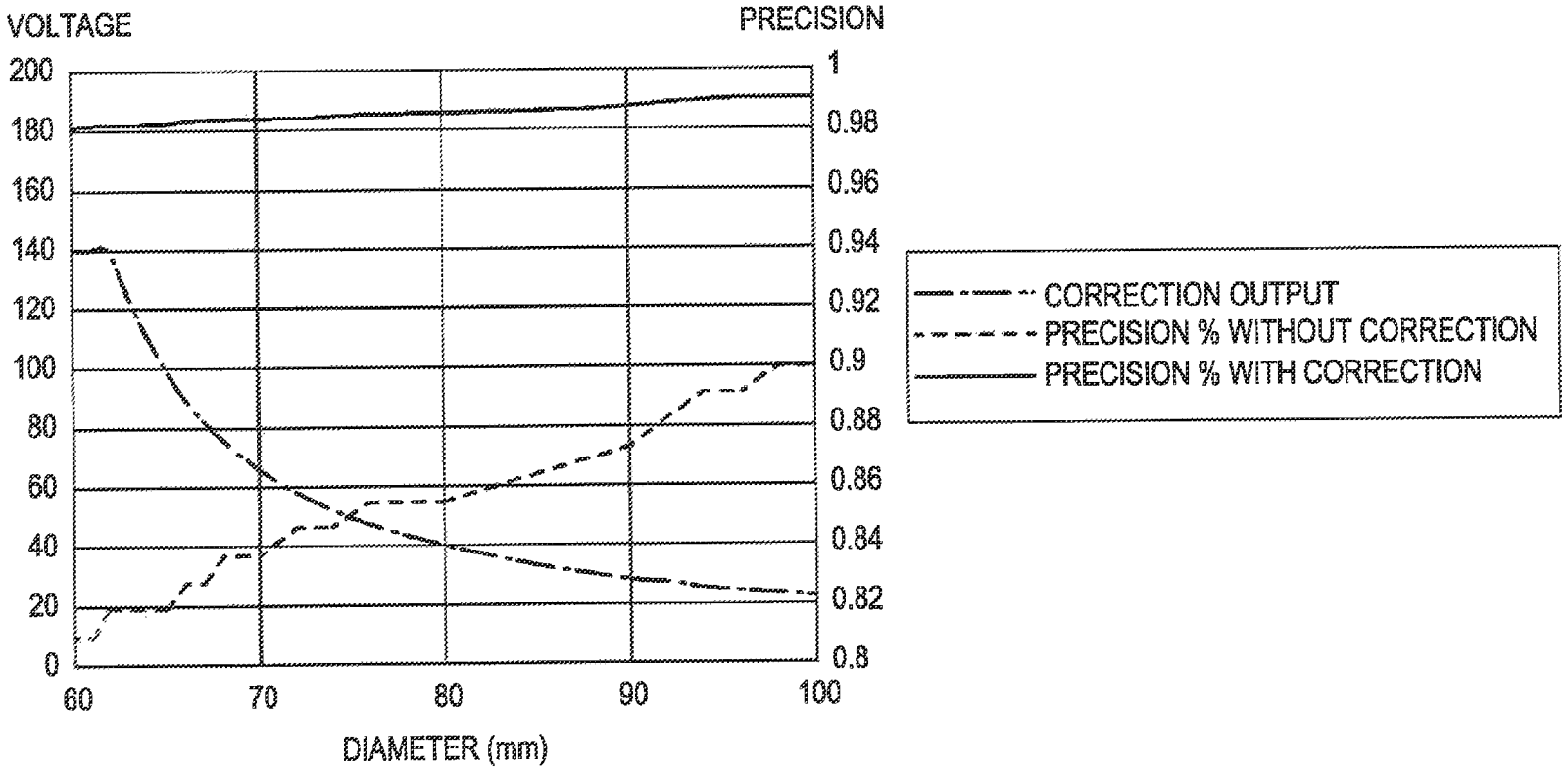
FIG. 20 is a diagram showing the relationship between the diameter of the medium that is wound around the roll body and correction assistance, and the effects of the correction assistance.

FIG. 20 is a diagram showing the relationship between the diameter of the paper P that is wound around the roll body RP and the correction assistance, and the effects of the correction assistance. In FIG. 20, the vertical axis on the left represents a voltage, and the vertical axis on the right represents transport precision. In addition, the closer the precision is to 1, the better (the transport precision is high). Also, in FIG. 20, the horizontal axis represents the diameter (here, the radius) of the paper P that is wound around the roll body RP.

Also, a dashed-dotted line in the drawing shows an output voltage (equivalent to Ma of FIG. 17) of the correction assistance, a dotted line shows the transport precision when there is no correction assistance, and a solid line shows the transport precision in a case where there is the correction assistance. In addition, FIG. 20 is one example of the results when the printing has been performed by using the slippery paper (for example, a film-like member).

As shown in the drawing, the magnitude of the correction assistance (the dashed-dotted line) is in inverse proportion to the diameter of the paper P that is wound around the roll body RP. For example, the output voltage of the correction assistance is larger when the radius of the paper P that is wound around the roll body RP is 70 mm than when the radius is 90 mm. Therefore, the smaller the diameter of the paper P that is wound around the roll body RP, the larger the electric power which is supplied at the time of the driving of the RR motor 33 (at the time of the start of the feeding of the paper P of the roll body RP) becomes.

In a case where the correction assistance is not applied (the case of only the initial assistance), as the diameter of the paper P that is wound around the roll body RP becomes smaller, the transport precision deteriorates. That is, the slippage amount increases. Therefore, it is not possible to place ink at a target position of a medium, which results in image quality deterioration. In particular, in a case where the number of ink colors which is used is small (for example, the case of four colors), deterioration of image quality becomes prominent.

On the other hand, if the correction assistance is applied, as shown by the solid line in the drawing, nearly constant and high transport precision can be obtained regardless of the diameter of the paper P that is wound around the roll body RP. In this manner, by applying the correction assistance, even if the slippery paper P is used, it is possible to increase the transport precision regardless of the diameter of the paper P that is wound around the roll body RP.

As explained above, the printer 10 of this embodiment is provided with the RR motor 33 which drives the shaft of the roll body RP in which the paper P is wound, in the feeding direction of the paper P, the transport roller 51*a* which transports the paper P fed from the roll body RP, and the control section 100 (the RR motor control section 112) which supplies the electric power for rotating the roll body RP to the RR motor 33. Then, at the time of the start of the feeding of the paper P, the RR motor control section 112 acts so as to increase the electric power which is supplied to the RR motor 33, in accordance with a reduction in the diameter of the paper P that is wound around the roll body RP. By this, even in the case of using a slippery medium, it is possible to improve the transport precision regardless of the diameter of the paper P that is wound around the roll body RP, so that deterioration of image quality can be prevented.

Other Embodiments

The printer as one embodiment, or the like has been described. However, the above-described embodiment is for facilitating the understanding of the invention, but is not intended to mean the invention as being limited thereto. The invention can be modified or improved without departing from the purpose thereof, and it is also needless to say that the equivalents thereto are included in the invention. In particular, embodiments which are described below are also included in the invention.

In the above-described embodiment, the case of the printer is explained. However, this embodiment is not limited to the printer, but may also be applied to a facsimile or the like, which uses a roll body (roll paper). Also, it may also be applied to a portion of a multi-function apparatus such as a scanner apparatus or a copy apparatus. Also, in the above-described embodiment, the ink jet type printer is described. However, if the printer is a type capable of ejecting fluid, it is not limited to the ink jet type printer. It is possible to apply this embodiment to various printers such as a gel jet type printer, a toner type printer, and a dot impact type printer, for example.

Also, the control section 100 is not limited to that in the above-described embodiment, but may also be configured so as to perform the control of the RR motor 33 and the PF motor 53 only by the ASIC 105, for example, and besides these, the control section 100 may also be constituted by combining a single-chip microcomputer in which various peripheral devices are incorporated, or the like.

Also, in the above-described embodiment, the paper P is not limited to paper or a film-like member, but a sheet made of resin, aluminum foil, or the like may also be used. Also, in this embodiment, the correction assistance is applied to the case of a slippery medium. However, also with a medium (for example, plain paper) other than the slippery medium, the correction assistance may be applied. In addition, if the correction assistance is applied to the slippery medium like this embodiment, the effect of further increasing the transport precision can be obtained.

What is claimed is:

1. A printing apparatus comprising:

a roll body motor that drives a shaft of a roll body so as to feed a medium that is wound around the roll body;

a paper feed motor that drives a transport roller which transports the medium fed from the roll body; and a control section which supplies electric power to the roll body motor for rotating the roll body and to the paper feed motor for drawing the medium from the roll body, wherein the control section supplies an assistance electric power to the roll body motor after applying electric power to the paper feed motor and at a time corresponding to a start of a feeding of the medium, the assistance electric power being in inverse proportion to a diameter of the medium wound around the roll body, and wherein the control section removes the assistance electric power when the roll body starts rotating, and wherein the assistance electric power includes a first assistance power that assists the driving of the roll body motor and does not depend on the diameter of the medium that is wound around the roll body and second assistance power that assists the driving of the roll body motor and is calculated by the control section separately from the first assistance power in accordance with the diameter of the roll body.

2. The printing apparatus according to claim 1, wherein the second assistance power is in inverse proportion to the diameter of the medium that is wound around the roll body.

3. The printing apparatus according to claim 1, wherein the control section adjusts the electric power which is supplied to the roll body motor, by changing a duty value in PWM control.

4. The printing apparatus according to claim 1, wherein the medium is more slippery than a reference medium.

5. The printing apparatus according to claim 4, wherein the reference medium is plain paper.

6. The printing apparatus according to claim 1, wherein the assistance electric power comprises initial assistance power and correction assistance power.

7. A printing apparatus comprising:

a roll body motor which drives a shaft of a roll body in a feeding direction of a medium that is wound around the roll body;

a paper feed motor that drives a transport roller which transports the medium fed from the roll body; and a control section that supplies electric power to the roll body motor for rotating the roll body and to the paper feed motor for drawing the medium from the roll body, the control section supplying a first electric power to the roll body motor after supplying electric power to the paper feed motor and at a time corresponding to a start of a feeding of the medium and removing the first electric power when the roll body starts rotating;

wherein, when a slipperiness of the medium is greater than a slipperiness of a reference medium, the first electric power comprises an initial assistance power and a correction assistance power;

wherein when the slipperiness of the medium is equal to or less than the slipperiness of the reference medium, the first electric power does not include the correction assistance power; and wherein the correction assistance power is calculated by the control section separately from the initial assistance power and is in inverse proportion to a diameter of the medium that is wound around the roll body.

8. The printing apparatus according to claim 7, wherein the control section turns off the initial assistance power and the correction assistance power in response to the roll body beginning to move.

9. The printing apparatus according to claim 7, wherein the initial assistance power is independent of the diameter of the medium that is wound around the roll body.

* * * * *